US008444452B2

(12) United States Patent
Dang et al.

(10) Patent No.: US 8,444,452 B2
(45) Date of Patent: May 21, 2013

(54) WIRELESS MUSICAL FIGURINES

(75) Inventors: Phu Dang, Shawnee, KS (US); Ka Wai Ng, Hong Kong (CN)

(73) Assignee: Hallmark Cards, Incorporated, Kansas City, MO (US)

( * ) Notice: Subject to any disclaimer, the term of this patent is extended or adjusted under 35 U.S.C. 154(b) by 225 days.

(21) Appl. No.: 12/911,002

(22) Filed: Oct. 25, 2010

(65) Prior Publication Data

US 2011/0059677 A1 Mar. 10, 2011

(51) Int. Cl.
*A63H 5/00* (2006.01)

(52) U.S. Cl.
USPC ..... 446/397; 446/491; 84/600; 84/609

(58) Field of Classification Search ..... 446/397, 446/491; 84/600, 609
See application file for complete search history.

(56) References Cited

U.S. PATENT DOCUMENTS 4,169,335 A 10/1979 Betancourt
5,587,545 A * 12/1996 Nakada et al. ..... 84/600
6,110,000 A 8/2000 Ting
6,149,490 A 11/2000 Hampton et al.
6,309,275 B1 10/2001 Fong et al.
6,375,535 B1 4/2002 Fong
6,454,625 B1 9/2002 Fong
6,497,604 B2 12/2002 Fong
6,497,606 B2 12/2002 Fong
6,497,607 B1 12/2002 Hampton
6,514,117 B1 2/2003 Hampton
6,641,454 B2 11/2003 Fong
6,822,154 B1 * 11/2004 Thai ..... 84/609
7,297,044 B2 11/2007 Small
2004/0038620 A1 * 2/2004 Small et al. ..... 446/491

FOREIGN PATENT DOCUMENTS

JP 2004219870 A * 8/2004

* cited by examiner

*Primary Examiner* — Tramar Harper
(74) *Attorney, Agent, or Firm* — Shook, Hardy & Bacon L.L.P.

(57) ABSTRACT

A method, system, and medium are provided for a wireless musical figurine belonging to a set of wireless musical figurines that play audio files in coordination with one another. One system of the musical figurine includes a wireless transceiver utilized to communicate with one or more musical figurines. The musical figurine also includes a set of master audio files of a first quality level, and a set of slave audio files of a second quality level. An audio player plays an audio file from the set of master audio files or the set of slave audio files. A master audio file is played when the musical figurine is initiated in accordance with a user indication, and a slave audio file is played when the musical figurine is initiated by another musical figurine. The musical figurine may also have movement capabilities which may be coordinated with the playing of an audio file to present a dancing figurine.

20 Claims, 7 Drawing Sheets

| AUDIO DEVICE | MASTER AUDIO FILE(S) | SLAVE AUDIO FILE(S) |
|---|---|---|
| 1 | A1, B1 | C1, D1, E1, F1, G1, H1 |
| 2 | C2, D2 | A2, B2, E2, F2, G2, H2 |
| 3 | E3, F3 | A3, B3, C3, D3, G3, H3 |
| 4 | G4, H4 | A4, B4, C4, D4, E4, F4 |

WIRELESS MUSICAL FIGURINES

SUMMARY

Embodiments of the present invention include a plurality of musical figurines that wirelessly interact to play music in coordination with one another. Each of the musical figurines presents a unique member of a musical group. For example, a first musical figurine may present a piano piece to Song A and a second figurine may present a guitar piece to Song A. The musical figurines are synchronized such that the piano piece of Song A is played in coordination with the guitar piece of Song A. This summary is not intended to identify key features or essential features of the claimed subject matter, nor is it intended to be used as an aid in isolation to determine the scope of the claimed subject matter.

BRIEF DESCRIPTION OF THE SEVERAL VIEWS OF THE DRAWINGS

Illustrative embodiments of the present invention are described in detail below with reference to the attached drawing figures, and wherein.

DETAILED DESCRIPTION

The subject matter of embodiments of the present invention is described with specificity herein to meet statutory requirements, but the description itself is not intended to necessarily limit the scope of claims. Rather, the claimed subject matter might be embodied in other ways to include different steps or combinations of steps similar to the ones described in this document, in conjunction with other present or future technologies. Terms should not be interpreted as implying any particular order among or between various steps herein disclosed unless and except when the order of individual steps is explicitly described.

Embodiments of the present invention may be embodied as, among other things: a method, system, or set of instructions embodied on one or more computer-readable media. Computer-readable media include both volatile and nonvolatile media, removable and nonremovable media, and contemplates media readable by a database, a switch, and various other network devices. By way of example, and not limitation, computer-readable media comprise media implemented in any method or technology for storing information. Examples of stored information include computer-useable instructions, data structures, program modules, and other data representations. Media examples include, but are not limited to information-delivery media, RAM, ROM, EEPROM, flash memory or other memory technology, CD-ROM, digital versatile discs (DVD), holographic media or other optical disc storage, magnetic cassettes, magnetic tape, magnetic disk storage, and other magnetic storage devices. These technologies can store data momentarily, temporarily, or permanently.

Figure 1:
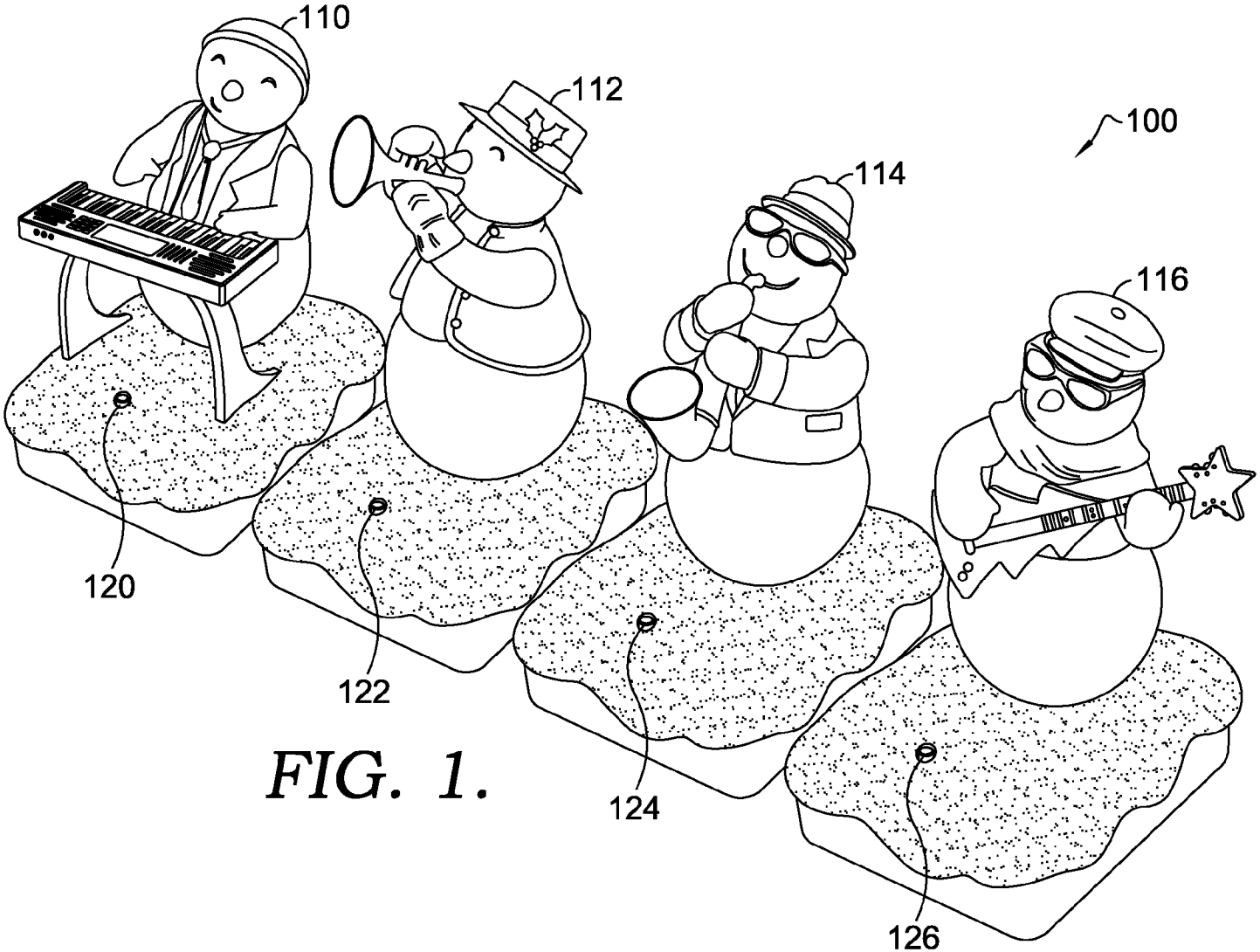
FIG. 1 is a front perspective view of a set of wireless musical figurines, in accordance with an embodiment of the present invention.

Referring to the drawings generally, and initially to FIG. 1 in particular, one embodiment of the present invention includes a plurality of musical figurines 100 that wirelessly interact with each other to provide coordinated audio (e.g., play music) and/or movement. FIG. 1 is provided herein to illustrate an example of one implementation of the present invention and is not intended to limit the scope of the invention. As illustrated in FIG. 1, the plurality of musical figurines 100 include musical figurine 110, musical figurine 112, musical figurine 114, and musical figurine 116. As can be appreciated, any number of musical figurines can be included within a set of musical figurines. In embodiments, each musical figurine presents a different member of a musical group (e.g., a band, an orchestra, a vocal group, etc.). For example, the musical figurines 110, 112, 114, and 116 are snowmen and each member has its own instrument. Each musical figurine plays music in accordance with their respective instrument. In this regard, musical figurine 110 plays piano music, musical figurine 112 plays trumpet music, musical figurine 114 plays saxophone music, and musical figurine 116 plays guitar music.

Although not illustrated, each musical figurine 110, 112, 114, and 116 can be programmed with master songs, which can be used by the figurine to lead the musical group, and slave songs, which can be used by the figurine to play along with other members of the musical group. Each of the slave songs in a particular musical figurine corresponds to a master song of one of the other musical figurines of the group. For example, assume each musical figurine 110, 112, 114, and 116 includes two master songs and six slave songs. In such a case, the six slave songs of musical figurine 110 correspond with the two master songs of musical figurine 112, the two master songs of musical figurine 114, and the two master songs of musical figurine 116.

A musical figurine can be activated by pressing an activation button in association with a musical figurine, such as activation button 120 of musical figurine 110, activation button 122 of musical figurine 112, activation button 124 of musical figurine 114, and activation button 116 of musical figurine 126. When an activation button of a musical figurine 110 is selected, the musical figurine begins playing a master song (e.g., one of its two master songs). Such a master song may be stored as a high quality recording (e.g., a waveform audio file format (.wav)). By way of example only, assume activation button 120 of musical figurine 110 is selected by a user. In such a case, musical figurine 110 begins playing a master song stored therein in accordance with the piano musical piece.

The activated musical figurine, such as musical figurine 110, initially plays the master song as a solo. While the master song is being played as a solo, a join-in signal is broadcast which may be received by all other musical figurines that are in communication range, such as musical figurines 112, 114, and 116. After a predetermined period of time, such as three seconds of the solo, the master musical figurine (e.g., the musical figurine 110) may send out another join-in signal. In response to recognizing the join-in signal, any slave musical figurines in communication range of the master musical figurine begin playing along with the master musical figurine using a corresponding slave song. For example, assume musical figurine 110 is activated and performs as the master. In such a case, musical figurines 112, 114, and 116 will perform as slaves and join in the audio performance upon receiving the join-in signal. Musical figurines 112, 114, and 116 each play a particular instrument part of the song. Such audio is projected via a speaker of the corresponding musical figurine. By way of example and with reference to FIG. 1, the music played by musical figurine 112 is the trumpet piece of the song, the music played by musical figurine 114 is the saxophone piece of the song, and the music played by musical figurine 116 is the guitar piece of the song. In embodiments, each of the slave songs are stored in a lower quality format (e.g., a musical instrument digital interface (MIDI) file) such that the slave musical figurines sound like they are background players to the musical figurine functioning as the master musical figurine.

Figure 2:
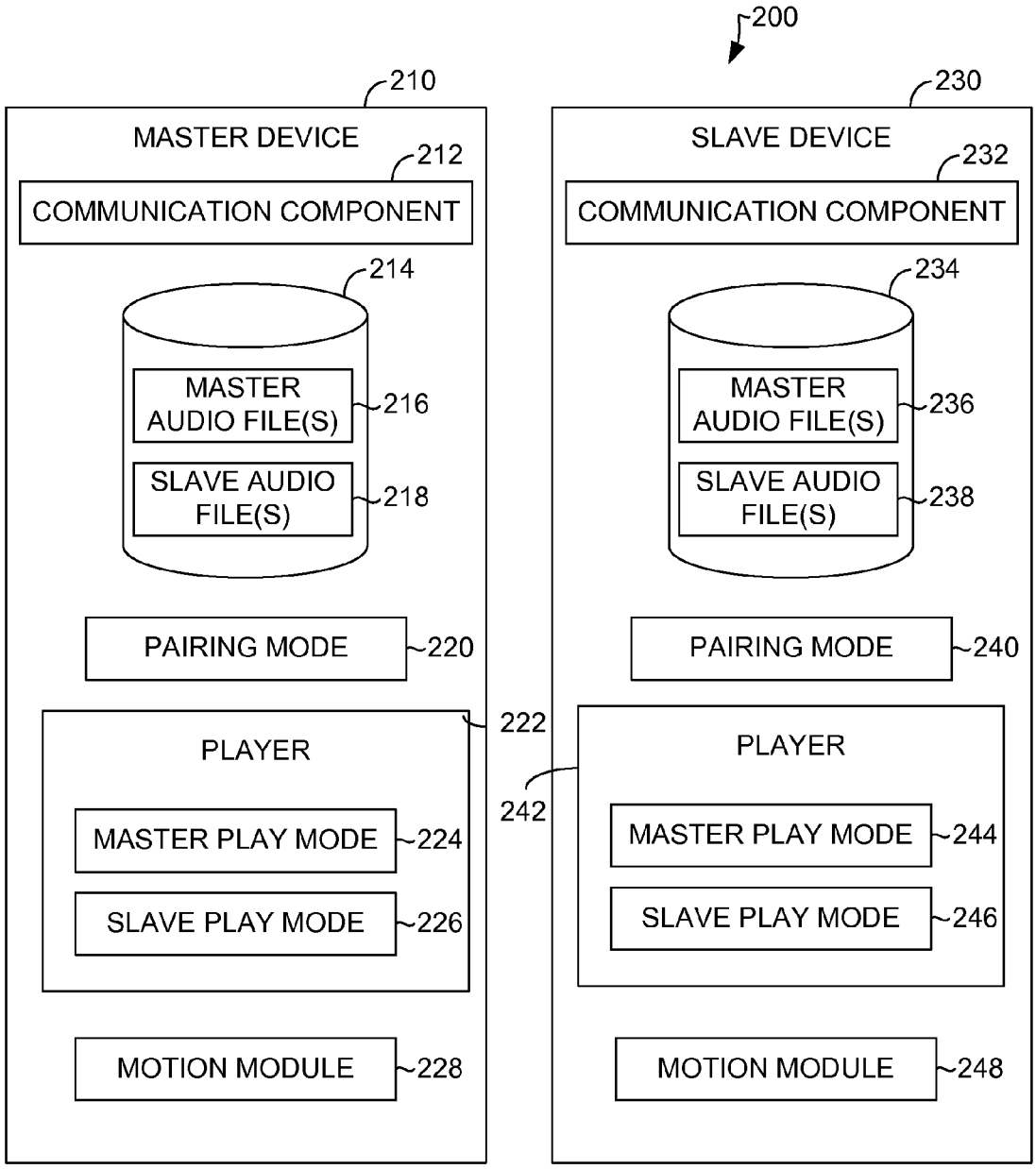
FIG. 2 is a block diagram of an exemplary computing system that is suitable for operation of an embodiment of the present invention.

Referring now to FIG. 2, a computing system 200 for practicing an embodiment of the present invention is provided. It will be understood and appreciated by those of ordinary skill in the art that the computing system 200 shown in FIG. 2 is merely an example of one suitable computing system and is not intended to suggest any limitation as to the scope of use or functionality of the present invention. Neither should the computing system 200 be interpreted as having any dependency or requirement related to any single component or combination of components illustrated therein. The single unit depictions are meant for clarity, not to limit the scope of embodiments in any form.

Figures 3, 4:
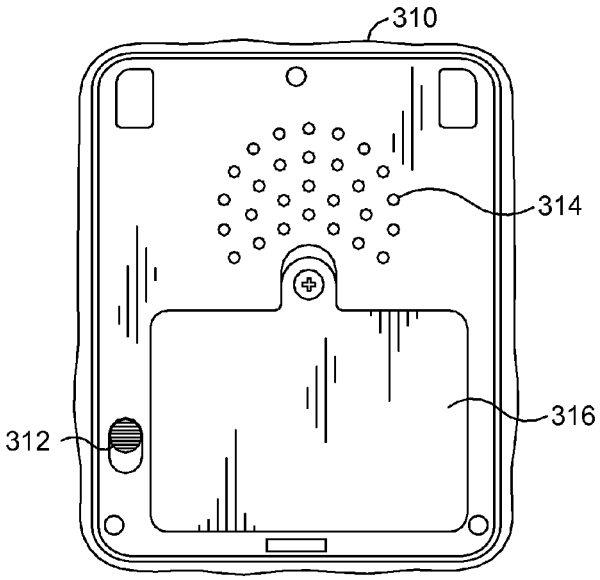
FIG. 3 is a bottom plan view of a wireless musical figurine, in accordance with an embodiment of the present invention.
FIG. 4 is a block diagram illustrating a plurality of audio devices with corresponding master audio files and slave audio files, in accordance with an embodiment of the present invention.

As shown in FIG. 2, an exemplary computing system 200 includes a master device 210 and a slave device 230. The master device 210 and the slave device 230 can be any electronic device having audio capabilities, that is, a device capable of storing and presenting audio files. Accordingly, a master and/or slave device may be an audio device that can take on a variety of forms. In embodiments, the master device 210 and the slave device 230 represent or are embodied in figurines, such as the snowmen musical figurines shown in FIG. 1. As illustrated in FIG. 3, an audio device 310 (e.g., master device 210 and/or slave device 230) can include, for example, a power switch 312, a speaker(s) 314, a power source(s) 316 (e.g., a battery source), and the like.

As can be appreciated, computing system 200 of FIG. 2 may include any number of audio devices, such as musical figurines, capable of storing and presenting audio files. By way of example only, computing system 200 may include a total of five musical figurines with one of the musical figurines that represents a master device for a particular performance cycle while the remaining four musical figurines represent slave devices for the same performance cycle. A performance cycle, as used herein, refers to a duration of a play mode (e.g., master play mode or slave play mode). In at least one embodiment, a performance cycle begins with an activation indication and ends upon completion of presenting an audio file. Accordingly, upon recognizing an activation indication, the audio device initially activated performs as a master device until completion of an audio file, and the audio devices that play along with the master device perform as slave devices until completion of their corresponding audio files.

Although designated as a master device 210 and a slave device 230, the master device 210 may function as both a master and a slave, and the slave device 230 may function as both a master and a slave. In this regard, in one instance, the master device 210 may perform as a master in that the master device 210 is initially activated (e.g., automatically or via a user selection) to present an audio file. At a later instance, the master device 210 may perform as a slave in that it is triggered to present an audio file as a result of another audio device functioning as a master. The audio devices are designated as the master device 210 and the slave device 230 for purposes of demonstration and are not intended to indicate that an audio device performs only as a master or a slave, respectively. Rather, the master device 210 may perform as a master during one performance cycle and may perform as a slave device during another performance cycle.

The master device 210 and the slave device 230 are capable of communicating with one another. The master device 210 and the slave device 230 both include a communication component 212 and 232, respectively, used to transmit and receive communication signals, such as radio frequency signals. In embodiments, the communication components 212 and 224 are wireless transceivers used for communication. As can be appreciated, such communication may be one-way communication or two-way communication. In the case of one-way communication, communication is provided from an audio device functioning as a master, such as master device 210, and is received by one or more audio devices functioning as a slave, such as slave device 230. By way of example only, assume that in a first instance, master device 210 functioning as a master communicates with the slave device 230 functioning as a slave via one-way communication. Further assume that, at a later instance, the slave device 230 functions as the master and the master device 210 functions as the slave. In such a case, the one-way communication is provided from the slave device 230 and directed to the master device 210. Accordingly, although the master device 210 and the slave device 230 generally communicate with one another, one-way communication (e.g., from the master device 210 to the slave device 230) is generally utilized during a particular performance cycle.

In one embodiment, the master device 210 and the slave device 230 are capable of communicating via radio frequency signals, for example, using 2.4 GHz radio frequency signals. In an alternative embodiment, the master device 210 and the slave device 230 may communicate using a communications network(s). A network(s) might comprise, for example, a cable network, the Internet, a wireless network (e.g., a wireless telecommunications network), or a combination thereof or portions thereof. Other known wireless communication methods (e.g., infrared) are within the scope of the present invention.

The master device 210 and the slave device 230 include a data store 214 and 234, respectively, that stores audio files, such as music, scripts, movement information, etc. Both of the data stores 214 and 234 include a set of one or more master audio files 216, 236 and a set of one or more slave audio files 218, 238. Master audio files are audio files initiated and played when a figurine 100 functions as a master, such as the master device 210. Slave audio files are audio files initiated by another device 100 that is performing as the master (i.e., initially activated by a user or automatically activated). In embodiments, the master audio files 216, 236 are stored as high quality recordings, such as .wav files, and the slave audio files 218, 238 are stored in a lower quality format, such as MIDI files. Such an embodiment can assist in the storage capabilities of the audio devices and/or the sound quality. For example, using an MIDI file format for slave audio files results in a slave device sounding as background music to the master device.

Although the master device 210 and the slave device 230 include a set of master audio files and a set of slave audio files, the audio files designated as master audio files and the audio files designated as slave audio files are different for each different type of device 100. As previously discussed, a device performing as a master device can later perform as a slave device and, conversely, a device performing as a slave device can later perform as a master device. Accordingly, a master audio file in one device (e.g. master device) corresponds with a slave audio file in other devices (e.g., a slave device). While a device may perform as a master device in one instance and a slave device in another instance, the audio files designated as master and slave are not modified.

By way of example only, as shown in FIG. 2, a single master device 210 and a single slave device 230 are in communication. The set of master audio files 216 in the data store 214 of the master device 210 correspond with the set of slave audio files 238 in the data store 234 of the slave device 230, and the set of master audio files 236 in the slave device 230 correspond with the set of slave audio files 218 in the data store 214 of the master device 210. If several slave devices exist, the slave audio files 218 in the master device 210 correspond with the master audio files of each slave device. As can be appreciated, in some embodiments, even if a user does not possess each audio device 100 within a set of audio devices, the set of slave audio files within each audio device may correspond with the master audio files of all possible slave devices such that each audio device is prepared to adequately function in the event an additional slave device is purchased.

By way of further example, and with reference to FIG. 4, a plurality of audio devices are illustrated with corresponding slave and master audio files. As is shown in FIG. 4, Device 1 includes master audio files A1 and B1 and slave audio files C1, D1, E1, F1, G1, and H1. Device 2 includes master audio files C2 and D2 and slave audio files A2, B2, E2, F2, G2, and H2. Device 3 includes master audio files E3 and F3 and slave audio files A3, B3, C3, D3, G3, and H3. Device 4 includes master audio files G4 and H4 and slave audio files A4, B4, C4, D4, E4, and F4. The letters A, B, C, D, E, F, G, and H generally represent an audio, such as a song, and the numbers 1, 2, 3, and 4 represent a version of the audio, such as a particular musical piece of a song (e.g., piano piece, guitar piece, etc). In this way, FIG. 4 demonstrates that if Device 1 is performing as the master device and plays master audio file A1, for example, via a .wav file, Devices 2, 3, and 4 can respectively join in playing slave audio files A2, A3, and A4, for example, via a lower quality format such as MIDI files.

The master device 210 and the slave device 230 also include a pairing mode 220 and 240, respectively. A pairing mode is utilized to coordinate communication of a set of the audio devices 100. In this regard, the pairing mode enables communication among audio devices. In embodiments, audio devices can communicate using radio frequency signals (e.g., 2.4 GHz) and can thereby operate on different channels, for instance, in order to avoid interference with other 2.4 GHz devices. The pairing mode allows a set of audio devices, such as musical figurines 100, to utilize a common channel. The pairing mode can also be used to eliminate or avoid interference from other devices (i.e., non-audio devices or other devices not related to this invention).

An audio device may enter the pairing mode when the audio device is initially turned on (i.e., powered, for example, via power button 312 of FIG. 3). Initially, the audio device listens on or scans channels and determines if any other audio devices 100 are set to or utilizing a channel. If it is determined that another audio device(s) 100 is on a particular channel, the audio device in pairing mode establishes or maintains a connection with that particular channel. In this regard, the audio device sets its channel to correspond with the particular channel already being used by another audio device(s). As can be appreciated, audio devices 100 may broadcast a signal, for example, using a "pulse" to indicate a particular channel being used. In some embodiments, the pairing audio device may be configured to analyze all possible channels. In other embodiments, the pairing audio device may analyze channels until a channel is detected as being used by another audio device.

If the audio device 100 fails to identify another audio device(s) utilizing or set to a channel(s), the audio device can generate a group identifier (ID) and send out the group ID to coordinate communication of the set of audio devices. Such a group ID may be broadcast in a broadcast signal, such as a steady "pulse." In embodiments, the audio device may also begin presenting one of its audio files. For example, a master audio file, or a portion thereof, may be presented upon powering an audio device and during pairing of the device. Other data may also be broadcast, such as, for example, channel information.

By way of example only, an audio device may broadcast a pairing request on one of a defined list of channels. Upon broadcasting the pairing request, the audio device listens to signals on that channel. In cases that the audio device does not hear anything or hears a signal without a "snowman" group ID, the audio device listens to signals on another channel. When the audio device hears a signal on a particular channel with an appropriate "snowman" group ID, the audio device uses the group ID and transmits a join-in signal to perform a song. The song may provide an indication to a user that the two or more audio devices have paired successfully. If another device (external to the set of audio devices being paired) uses the same channel after pairing, such signals transmitted by the other device via that channel can be ignored by the paired audio devices because that other device is not utilizing the "snowman" group ID. In cases that the audio device does not detect any signals after listening on all of the available channels on the list, the audio device assumes that no other audio devices are within communication range that have established a channel. In such a case, the audio device may generate and broadcast a group ID coordinate communication.

The master device 210 and the slave device 230 also include a player 222 and 242, respectively. Players 222 and 242 are utilized to provide an audio presentation of an audio file. The players 222 and 242 include a master play mode and a slave play mode. As illustrated in FIG. 2, the master device 210 includes master play mode 224 and slave play mode 226. Similarly, the slave device 212 includes master play mode 244 and slave play mode 246. In this regard, in the instance that an audio device performs as a master, the audio device performs the functionality of the master play mode. By contrast, in the instance that the audio device performs as a slave, the audio device performs the functionality of the slave play mode. Accordingly, while the master device 210 and the slave device 230 include both a master play mode and a slave play mode, the play mode used for a particular performance cycle is based on whether the audio device is functioning as a master or a slave.

The master device 210 and the slave device 230 also include a motion module 228 and 248, respectively. The devices 100, 210, 230 are preferably configured to be able to move during the playing of an audio file. In that regard, the figurines 100 may be provided with motion components (e.g., motors, gears, levers, etc.—not shown) that are contained within the bodies and/or base of the figurines 100 and can be powered by the power source 316. The motion components can be of any type known in the art and can be coupled with various portions of the figurines to give the appearance the figurine is dancing to the music it is playing during playback. As such, the movements can be timed to correspond with the sounds being played and can be stored in the data stores 214 and 234 as dance or movement routines.

Beginning with a description of the master play mode, the master play mode will be generally described with reference to the master device 210 for purposes of illustration. The master play mode 224 and 244 is configured to initiate performance of an audio. Initially, an activation indication is recognized by an audio device, such as the master device 210. An activation indication indicates that a master audio file is to be initiated by the master device. In one implementation, an activation indication is provided by a user selection. Accordingly, a user may select to initiate presentation of an audio file. For example, in one embodiment, a user may select an activation button, such as activation button 120, 122, 124, or 126 in FIG. 1. Selection of such an activation button generally designates the selected audio device as the master device. As can be appreciated, in some cases, a user may generally select an activation button to initiate performance of any audio file, which may be automatically selected by the device. In other cases, a user may select a particular audio file for presentation. For instance, an audio device may have multiple activation buttons each corresponding with a particular master audio file.

In another implementation, an activation indication may be provided automatically. In such a case, an activation indication may be provided randomly, periodically, upon occurrence of an event (e.g., sensors detect contact with the device, presence of a consumer, etc.). By way of example, assume a set of audio devices are dispersed within a room, such as a store. Further assume that it is desired that the devices provide musical enjoyment without requiring a user to intentionally activate an audio file for presentation. In such a case, the audio devices may be configured to initiate activation of an audio file periodically, randomly, or upon an occurrence of an event. In some embodiments, such an implementation may be performed based on a user indication, for example, press and hold an activation button for a predetermined amount of time (e.g., four seconds). Upon such an activation, an activation indication may be automatically provided, for example, upon a lapse of a predetermined time period (e.g., two minutes).

Upon recognizing an activation indication (e.g., provided automatically or via a user), a master audio file is selected for presentation. Such audio file selection may occur randomly or methodically. In this regard, one of the multiple master audio files may be randomly selected. Alternatively, a master audio file may be selected in accordance with a predetermined order. By way of example, assume that master device 210 includes two master audio files. In such a case, in response to an activation indication, a first audio file may be selected first and, upon a subsequent activation indication, the second audio file may be selected.

As can be appreciated, in some embodiments, an audio file selected for presentation can be designated by a user, for example, a user may select one of two activation buttons each corresponding with a unique audio file. Alternatively, in cases that an audio device includes a single master audio file, such an audio file may be selected each instance an activation indication is recognized.

Upon selecting a master audio file for presentation, presentation of the audio file begins. In this regard, the selected audio file is output, via a speaker(s), such that a user can hear the audio file. During the initial presentation of the audio file, the master device 210 may transmit a join-in signal such that other device(s) can perform as slave device(s) in accordance with the master device 210.

The master device 110 can provide a join-in signal to invite other devices 100 within communication range to join in the presentation of the audio as slave devices. The join-in signal provides an indication to a slave(s) within communication range to begin playing a corresponding slave audio file. As can be appreciated, in some embodiments, the join-in signal can be transmitted or broadcast during the initial solo presentation of the master audio file. In this regard, upon sending the join-in signal, audio devices join in as slave devices while the master device continues presentation of the audio file.

The join-in signal may include an indication of the master audio file being presented or a particular slave audio file to present (e.g., an audio identifier (ID)). Alternatively, the slave device(s) can be configured to determine the master audio file being presented or the particular slave audio file to present. In either case, the slave device 230 can select the audio file that corresponds with the audio file being played by the master device 210. By way of example, assume the master device 210 plays a master file of a piano part of Song A. In such a case, the slave device 230 selects a slave file of a guitar part of Song A. As can be appreciated, the master device 210 can initiate presentation of the audio file by the slave device 230 without receiving communication back from the slave device 230. In addition, a join-in signal may include a countdown timer, for example, that indicates an amount of time remaining before the slave device(s) is to join in the presentation. In some embodiments, join-in signals can be repeated during the initial solo presentation of the master audio file. By way of example only, a join-in signal may be transmitted several times during a three second solo played by a master audio device.

To maintain audio synchronization of the master device 210 and the slave device 230, in some embodiments, the master device 210 can transmit or broadcast clocking signals. Such clocking signals enable the slave device 230 to remain synchronized or become synchronized with the master device 210. Clocking signals may be transmitted or broadcast from a master to a slave randomly, periodically, upon an occurrence of an event (e.g., detect audio devices are not synchronized), etc. In other embodiments, the master device 210 and the slave device 230 maintain synchronization based on respective internal clocks (e.g., crystal clocks on the circuit boards). The accuracy of such clocks enables synchronization to be maintained between the master device 210 and the slave device 230.

Turning now to the slave play mode 226 and 246, the slave play mode will be generally described with reference to the slave device 230 for purposes of illustration. Initially, the slave device 230 wakes up to listen for join-in signals communicated from the master device 210. For example, the slave device 230 may wake up for a few milliseconds every second to listen for a join-in signal. In cases that a join-in signal is not recognized, the slave device 230 may return to sleep. As can be appreciated, in some embodiments, the slave device 230 may be configured to continuously listen for join-in signals. In this regard, the slave device 230 does not need to periodically wake up to listen for join-in signals.

Such a join-in-signal indicates that the master device 210 requests the slave device 230 to present a corresponding audio file in accordance with the audio file being played by the master device 210. In cases that a join-in signal is recognized, the slave device 230 recognizes and/or selects an audio file for audio presentation. In embodiments, as previously mentioned, the slave device 230 may recognize and/or select an audio file based on information provided by the join-in signal. Alternatively, the slave device 230 may recognize and select an audio file based on detection of an audio file being played by the master device 210.

The slave device 230 begins presentation of the selected slave audio file. In some cases, the slave audio file may begin at the beginning point of the audio file. In such a case, the beginning point of an audio file may disregard a beginning portion of a song such that audio file begins in synchronization with the master device 210. In other cases, the slave audio file may begin as designated by the master device 210 or in coordination with a detected position at which to begin (e.g., detected by the slave device 230) such that the master device 210 is synchronized with slave device 230. As previously mentioned, in some cases, the join-in signal includes a countdown timer. In such cases, the slave device 230 can, upon receiving the join-in signal, begin a timer or clock of the slave device 230 in accordance with the join-in signal and play the slave version of the song at the specified time.

In embodiments in which the master device 210 is configured to provide clocking signals to maintain audio synchronization, the slave device 230 receives the clocking signals transmitted from the master device 210. The slave device 230 utilizes such clocking signals to maintain synchronization with the master device and/or to synchronize with the master device 210.

Figure 5:
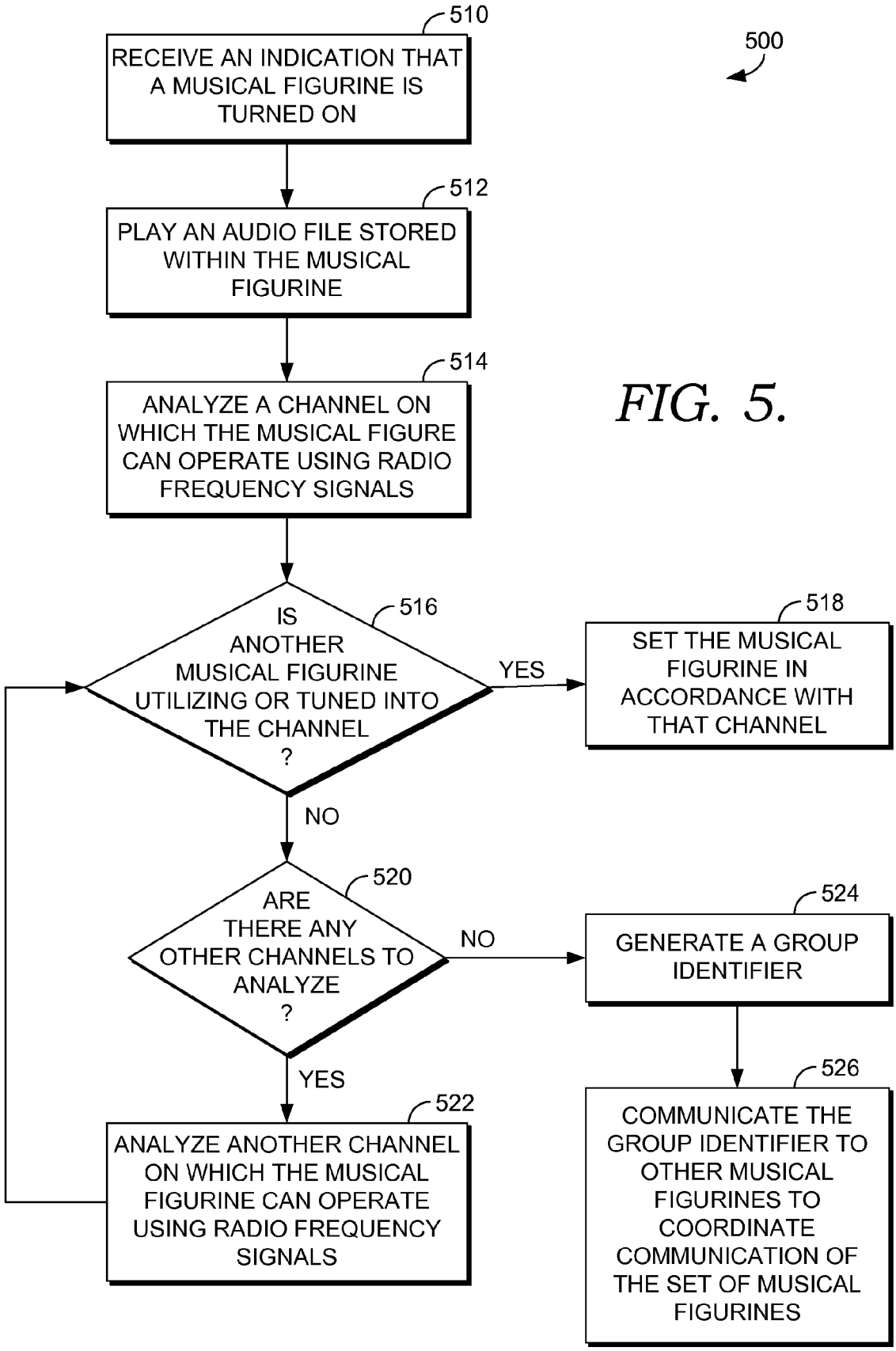
FIG. 5 is a flow chart which illustrates an exemplary method for coordinating wireless communication for a set of musical figurines, in accordance with an embodiment of the present invention.

By way of example only, and with reference to FIG. 5, an exemplary method 500 for coordinating wireless communication for a set of musical figurines is provided. Initially, as indicated at block 510, a musical figurine associated with a set of musical figurines receives an indication that the musical figurine is turned on or powered. For example, in embodiments, a user may select or toggle a power button, such as power button 312 of FIG. 3, to turn on the musical figurine. Subsequently, at block 512, the musical figurine begins playing an audio file (e.g., a master audio file) stored within the musical figurine. Such an audio file may be automatically selected, for example, randomly, by a predetermined default, methodically, etc. As the master audio file is presented, the musical figurine analyzes (e.g., scans or listens) a channel on which the musical figurine can operate using radio frequency signals (e.g., 2.4 GHz), as indicated at block 514. At block 516, the musical figurine determines if another musical figurine is utilizing or is tuned into that channel. If another musical figurine is utilizing or is tuned into that channel, the musical figurine sets in accordance with that channel, as indicated at block 518. In such a case, the musical figurine is in communication with at least one other musical figurine and can communicate therewith to play an audio file, for example, as a master device or a slave device.

If another musical figurine is not utilizing or is not tuned into that channel, it is determined, at block 520, whether there are any other channels to analyze, that is, that have not been initially listened to or scanned. If it determined that another channel exists that has not been initially analyzed for pairing, the musical figurine analyzes another channel on which the musical figurine can operate using, for example, radio frequency signals. This is indicated at block 522. Upon analyzing the new channel, the method returns to block 516 to determine if another musical figurine(s) is utilizing or is tuned into the new channel.

Returning to block 520, if it is determined that all channels that may be used for operation have been analyzed, at block 524, the musical figurine generates a group identifier. Subsequently, at block 526, the group identifier is communicated to other musical figurines to coordinate communication of the set of musical figurines. In this regard, the group identifier may be broadcast, for example, using a steady pulse.

Figure 6:
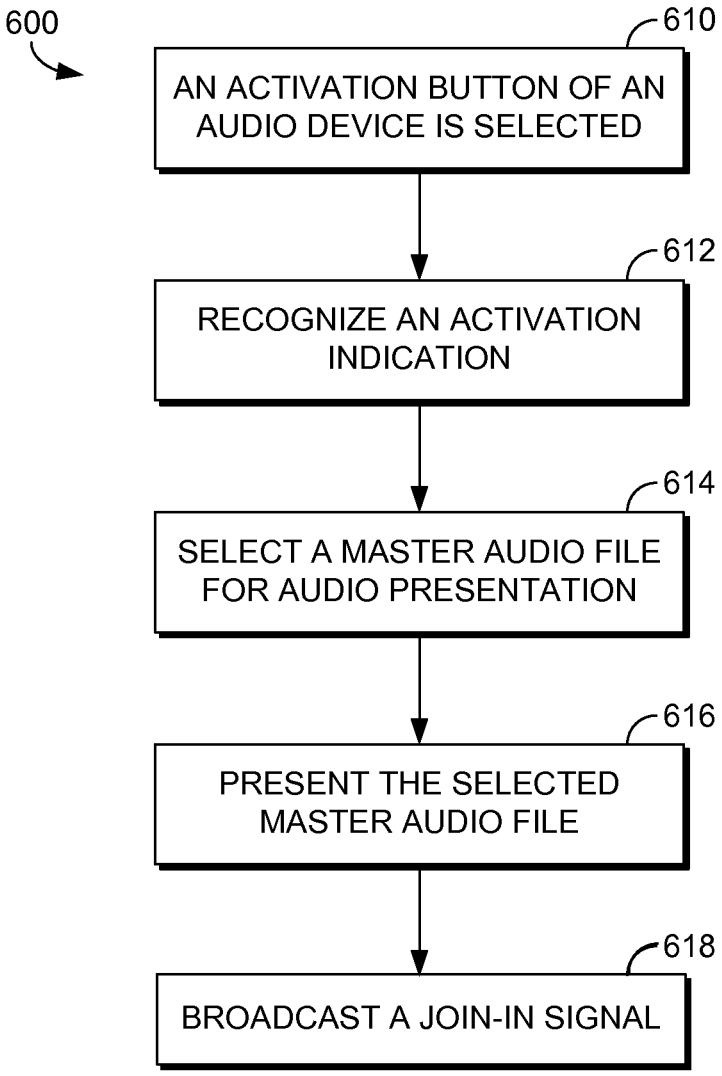
FIG. 6 is a flow chart which illustrates an exemplary first method for performing a master play mode, in accordance with an embodiment of the present invention.

Turning to FIG. 6, an exemplary first method 600 for performing a master play mode via an audio device is provided. Initially, as indicated at block 610, a user selects or toggles an activation button of an audio device to activate presentation of a master audio file. Subsequently, at block 612, an activation indication is recognized. Such an activation indication indicates that a master audio file is intended to be presented. At block 614, a master audio file is selected for audio presentation. In embodiments, the master audio file is stored in a high quality format. Thereafter, at block 616, the selected master audio file is initially presented. As other audio devices have yet to join in the audio presentation, the selected master audio file initially plays as a solo audio piece.

At block 618, a join-in signal is broadcast to initiate audio presentation of another audio device(s) within communication range. As can be appreciated, in some embodiments, the join-in signal provides an indication of a slave audio file to present upon a slave device receiving the join-in signal. Upon one or more slave audio devices receiving the join-in signal, such audio devices join in the audio presentation by playing a slave audio file that corresponds with the master audio file being played by the master device.

Figure 7:
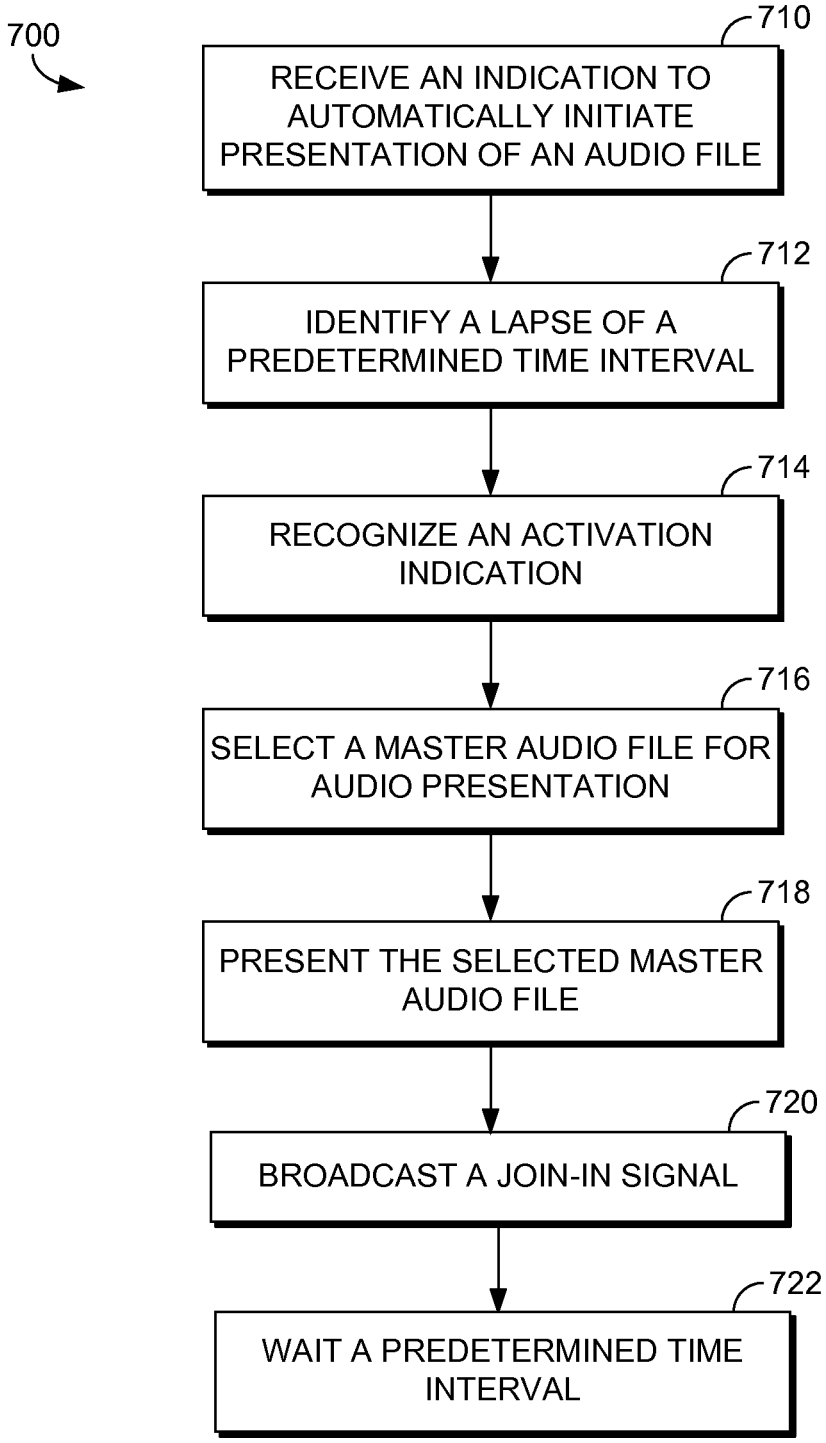
FIG. 7 is a flow chart which illustrates an exemplary second method for performing a master play mode, in accordance with an embodiment of the present invention.

With reference to FIG. 7, an exemplary second method 700 for performing a master play mode via an audio device is provided. Initially, as indicated at block 710, a musical figurine receives an indication to automatically initiate presentation of an audio file. Such an indication may be provided by a user by selecting and holding an activation button or other button for a predetermined amount of time. At block 712, a lapse of a predetermined time interval is identified. Subsequently, at block 714, an activation indication is recognized. As can be appreciated, in some embodiments, the activation indication may be the lapse of the predetermined time interval. At block 716, a master audio file is selected for audio presentation.

Thereafter, at block 718, the selected master audio file is presented. At block 720, a join-in signal is broadcast to initiate audio presentation of another audio device(s) within communication range. As can be appreciated, in some embodiments, the join-in signal provides an indication of a slave audio file to present upon a slave device receiving the join-in signal. Upon one or more slave audio devices receiving the join-in signal, such audio devices join in the audio presentation by playing a slave audio file that corresponds with the master audio file being played by the master device.

Upon completion of the presentation of the master audio file, the musical figurine waits until another lapse of the predetermined time interval occurs to initiate a presentation of a master audio file. This is indicated at block 722. As can be appreciated, in some cases, the musical figurine may join in an audio presentation as a slave device in accordance with a join-in signal provided by another audio device performing as a master device. In such cases, initializing presentation of a master audio file may be delayed until completion of the slave audio file, for example, in instances that the lapse of the predetermined time interval occurs during presentation of a slave audio file. Alternatively or additionally, the beginning of a predetermined time interval may be reset or modified upon completion of presentation of a slave audio file. For example, assume that a predetermined time interval that an audio device is to hold until initiating another master audio file is one minute. Further assume that after 30 seconds from completion of a presentation of a master audio file, the musical device joins in as a slave device to play along with another audio device. In such a case, upon completion of the slave audio file, the musical device may wait one minute before initiating another master audio file. Although method 700 of FIG. 7 is described using a predetermined time interval, as can be appreciated, a musical device can randomly initiate performance of a master audio file.

Figure 8:
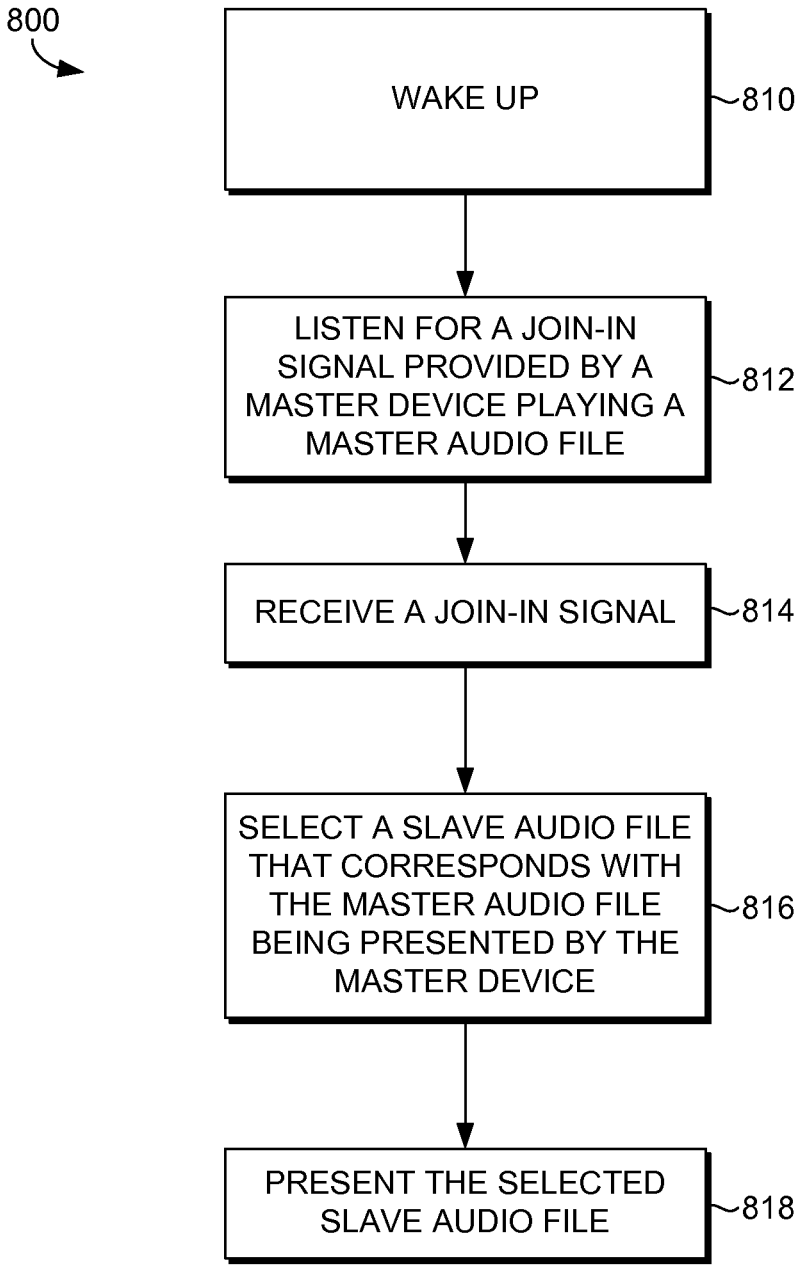
FIG. 8 is a flow chart which illustrates an exemplary method for performing a slave play mode, in accordance with an embodiment of the present invention.

Turning now FIG. 8, an exemplary method for performing a slave play mode by an audio device is provided. Initially, at block 810, a musical figurine wakes up. At block 812, the musical figurine listens for a join-in signal provided by a master device playing a master audio file. At block 814, a join-in signal is received. A slave audio file that corresponds with the master audio file being presented by the master device is selected, as indicated at block 816. At block 818, the selected slave audio file is presented beginning at a specific point. Accordingly, the slave audio file begins in unison with the previously initiated master audio file. The selected slave audio file may begin presentation in accordance with a countdown timer of the join-in signal. In this regard, upon receiving a join-in signal having a countdown timer, the musical figurine may set its time according to the countdown timer and play the slave audio file upon expiration of the countdown time.

It will be understood by those of ordinary skill in the art that the order of steps shown in the method 500 of FIG. 5, method 600 of FIG. 6, method 700 of FIG. 7, and method 800 of FIG. 8 are not meant to limit the scope of the present invention in any way and, in fact, the steps may occur in a variety of different sequences within embodiments hereof. Any and all such variations, and any combination thereof, are contemplated to be within the scope of embodiments of the present invention.

Many different arrangements of the various components depicted, as well as components not shown, are possible without departing from the scope of the claims below. Embodiments of our technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims. For example, not all steps listed in the various figures need be carried out or need to be carried out in the specific order described.

The invention claimed is:

1. One or more non-transitory computer-readable storage media having computer-useable instructions embodied thereon for performing a method of coordinating audio presentations of a set of wireless musical figurines, the method comprising:

identifying a lapse of a predetermined time interval;

upon the lapse of the predetermined time interval, automatically initiating a first audio presentation of a master audio file performed by a musical figurine, wherein a first portion of the master audio file is performed as a solo; and during the first audio presentation of the first portion of the master audio file, initiating a second audio presentation of a slave audio file performed by a slave musical figurine that is remote from the musical figurine, the second audio presentation beginning at a second portion of the master audio file and corresponding with the master audio file.

2. The media of claim 1, wherein the master audio file comprises a waveform audio file format.

3. The media of claim 1, wherein the slave audio file comprises a musical instrument digital interface format.

4. The media of claim 1, wherein the slave audio file is automatically initiated using one-way communication provided by the master device directed to the slave device.

5. The media of claim 1 further comprising selecting the master audio file for the first audio presentation.

6. The media of claim 1 further comprising selecting the slave audio file for the second audio presentation.

7. The media of claim 1, wherein initiating the second audio presentation comprises communicating a join-in signal to the slave device.

8. The media of claim 1, wherein the master audio file and the slave audio file include different musical instrument pieces for the same song.

9. The media of claim 1, further comprising waiting another lapse of the predetermined time period upon completion of the first audio presentation of the master audio file.

10. One or more non-transitory computer-readable storage media having computer-useable instructions embodied thereon for performing a method of coordinating audio presentations of a set of wireless musical figurines, the method comprising:

identifying a lapse of a predetermined time interval;

upon the lapse of the predetermined time interval, initiating a first audio presentation of a master audio file performed by a musical figurine, wherein a first portion of the master audio file is performed as a solo; and during the first audio presentation of the first portion of the master audio file, initiating a second audio presentation of a slave audio file performed by a slave musical figurine that is remote from the musical figurine, the second audio presentation beginning at a second portion of the master audio file and corresponding with the master audio file, wherein communication between the musical figurine and the slave musical figurine comprises only one-way communication during a performance cycle.

11. The method of claim 10, wherein the master audio file comprises a first file format of a first quality level, and the slave audio file comprises a second file format of a second quality level that is different from the first quality level.

12. A method of coordinating audio presentations of a set of wireless musical figurines, the method comprising:

identifying, at a musical figurine, a lapse of a predetermined time interval;

upon the lapse of the predetermined time interval, the musical figurine automatically initiating a first audio presentation of a master audio file performed by the musical figurine, wherein a first portion of the master audio file is performed as a solo; and during the first audio presentation of the first portion of the master audio file, a slave musical figurine initiating a second audio presentation of a slave audio file performed by the slave musical figurine that is remote from the musical figurine, the second audio presentation beginning at a second portion of the master audio file and corresponding with the master audio file.

13. The method of claim 12, wherein the master audio file comprises a waveform audio file format.

14. The method of claim 12, wherein the slave audio file comprises a musical instrument digital interface format.

15. The method of claim 12, wherein the slave audio file is automatically initiated using one-way communication provided by the master device directed to the slave device.

16. The method of claim 12 further comprising selecting the master audio file for the first audio presentation.

17. The method of claim 12 further comprising selecting the slave audio file for the second audio presentation.

18. The method of claim 12, wherein initiating the second audio presentation comprises communicating a join-in signal to the slave device.

19. The method of claim 12, wherein the master audio file and the slave audio file include different musical instrument pieces for the same song.

20. The method of claim 12, further comprising waiting another lapse of the predetermined time period upon completion of the first audio presentation of the master audio file.

* * * * *

UNITED STATES PATENT AND TRADEMARK OFFICE

CERTIFICATE OF CORRECTION

PATENT NO. : 8,444,452 B2
APPLICATION NO. : 12/911002
DATED : May 21, 2013
INVENTOR(S) : Phu Dang et al.

It is certified that error appears in the above-identified patent and that said Letters Patent is hereby corrected as shown below:

In the Specification

Column 2, line 52, "116" should read --126--.
Column 2, line 53, "126" should read --116--.
Column 4, line 21, "224" should read --232--.
Column 6, line 54, "212" should read --230--.
Column 8, line 8, "110" should read --210--.
Column 11, line 9, "Turning now FIG. 8, an exemplary method for performing" should read --Turning now to FIG. 8, an exemplary method 800 for performing--.

Signed and Sealed this
Tenth Day of March, 2015

Michelle K. Lee

Michelle K. Lee
*Deputy Director of the United States Patent and Trademark Office*